United States Patent [19]

Townsend

[11] 4,300,912

[45] Nov. 17, 1981

[54] SYNTHETIC FUEL CONTAINING METHANOL AND BUTANOL

[75] Inventor: David J. Townsend, Wheaton, Ill.

[73] Assignee: Union Carbide Corporation, New York, N.Y.

[21] Appl. No.: 194,774

[22] Filed: Oct. 7, 1980

[51] Int. Cl.[3] ..... C10L 1/18

[52] U.S. Cl. ..... 44/56; 44/66; 44/53; 252/356

[58] Field of Search ..... 44/56, 66, 53; 252/356

[56] References Cited

U.S. PATENT DOCUMENTS 1,570,060 1/1926 Hammond ..... 44/56
2,662,817 12/1953 Russell et al. ..... 44/53
3,822,119 7/1974 Frech et al. ..... 44/56
3,988,122 10/1976 Rosenthal et al. ..... 44/56

FOREIGN PATENT DOCUMENTS 2809481 7/1979 Fed. Rep. of Germany ..... 44/53

*Primary Examiner*—Jacqueline V. Howard
*Attorney, Agent, or Firm*—Gerald R. O'Brien, Jr.

[57] ABSTRACT

A long chain macro-molecule synthetic fuel derived by distillation-linking methanol, butanol and a kerosene type oil with a colloid stabilizer. The synthetic fuel, when mixed with conventional fuels, substantially reduces the generation of carbon monoxide, unburned hydrocarbons and nitrous oxides as combustion products.

12 Claims, No Drawings

SYNTHETIC FUEL CONTAINING METHANOL AND BUTANOL

BACKGROUND OF THE INVENTION

1. Field of the Invention

The present invention relates generally to the field of fuels and more particularly to a new and improved synthetic fuel.

2. Description of the Prior Art

Prior to the present invention a variety of additives have been produced to be combined with gasoline to increase octane ratings. Many of such additives in turn became a source of unacceptable carbon monoxide, unburned hydrocarbons and nitrous oxides. In the effort to reduce consumption of petroleum it is known to combine 195 proof ethanol as an extender with conventinal gasoline, generally in a 10%–90% ratio.

The ethanol-gasoline combination remains deficient in several respects. First, the ethanol is generally derived from otherwise useful feed grains such as corn. Second, the relatively low ratio utility of ethanol offers an inadequate displacement of gasoline. Third, the ethanol-gasoline combination is not significantly different from plain unleaded gasoline in terms of the generation of carbon monoxide, nitrous oxides and unburned hydrocarbons. Finally, ethanol is subject to phase separation from the gasoline in the presence of water.

OBJECTS AND SUMMARY OF THE INVENTION

From the foregoing it will be understood that among the various objectives of the present invention are:

to provide a new and novel synthetic fuel;

to provide a fuel of the above-described character which may be combined with petroleum fuels in increased ratios;

to provide a fuel of the above-described character which reduces the generation of carbon monoxide, unburned hydrocarbons and nitrous oxides; and to provide a fuel of the above-described character having improved stability.

These other objectives of the present invention are efficiently achieved by linking methanol, butanol and a kerosene type oil into a stable long chain macromolecule with a colloid stabilizer through distillation.

The foregoing as well as other objects, features and advantages of the present invention will become more apparent from the following detailed description.

DESCRIPTION OF PREFERRED EMBODIMENT

The applicant has discovered that by combining methanol (methyl alcohol), butanol (butyl alcohol) and a heavy hydrocarbon kerosene type oil (such as naptha) in the presence of a colloid stabilizer (magnesium laurel salts), a new and useful synthetic fuel may be very economically produced. He has further found that by varying the relative amounts of the three main ingredients the range of fuels from home heating oil, diesel fuel, automotive fuel and high performance aviation fuel may be obtained. For example, a fuel useful as a gasoline extender for automotive use is obtained by combining 40% naptha, 40% methanol and 20% butanol and adding 0.001 pound of magnesium laurel salts per gallon. The mixture is heated in a reactor to a temperature of 300 degrees Fahrenheit and the resulting vapors are passed through a water cooled condenser. The liquid fuel is collected in a holding tank.

A mixture of 25% synthetic fuel formulated as above with 75% unleaded gasoline and burned in a conventional automobile engine has been found to yield very substantial performance improvements from those of so-called "gasohol." More specifically, since the synthetic fuel has a substantial oxygen content, the stochiometric mixture of air to fuel is reduced from 14:1 to 4:1 and the production nitrous oxides is thereby substantially eliminated. Further, due to the high oxygen content of the synthetic fuel, the carbon content of the fuel is more completely oxidized in the combustion process yielding a higher amount of carbon dioxide and less carbon monoxide as well as substantially reduced unburned hydrocarbons in the exhaust gas.

In blending the ethanol-gasoline fuel it is necessary to scrupulously avoid the introduction of water since a content of as little as 5% water will cause the two constituents to separate. With the applicant's invention the use of the magnesium laurel salts as a stabilizer provides a very strong colloidal molecular link between the synthetic fuel and the gasoline which prevents this phase separation. A further advantage arises in that the colloidal molecular link, once established, involves such strong electronic forces that when any part of the chain is ignited the entire chain tends to ignite and combustion is more complete leaving less residue to foul an engine or burner. A still further advantageous result is that the applicant's synthetic fuel does not exhibit the adverse effects on rubber and plastic engine components exhibited by gasoline either alone or in mixture with ethanol.

The basic ingredients of the applicant's synthetic fuel are available in abundance from readily renewable sources. Methanol is economically produced by pyrolization of any organic matter including wood, garbage and sewage. Butanol is readily produced by fermentation of garbage, sewage or animal wastes using any one of a number of bacterial cultures. Naptha, as an inevitable by-product of the cracking process to produce gasoline from oil, is readily available and inexpensive. As an alternative to naptha, coal oil, vegetable oil or any other similar heavy hydrocarbon is useful in the practice of the applicant's invention. The term heavy hydrocarbon as used herein is defined as any hydrocarbon having sixteen or less carbon atoms and hydrogen atoms at least equal to the number of carbon atoms.

The utility of a fuel; e.g. heating oil as opposed to aviation fuel, is determined in large measure by its flash point. The flash points of the three main ingredients of the applicant's synthetic fuel are naptha—155 to 160 degrees Fahrenheit; butanol—90 degrees Fahrenheit; and methanol—42 degrees Fahrenheit. Thus, primarily by adjusting the methanol content the flash point of the synthetic fuel is adjusted to approximate that of the petroleum fuel with which it is to be mixed. For example, a mixture of 60% naptha, 30% butanol and 10% methanol and magnesium laurel salts in an amount of between 0.0001 and 0.001 pound per gallon yields a synthetic fuel having a flash point of appxoximately 115 degrees Fahrenheit which is compatible with the typical home heating oil. The range over which the mixture may be varied to produce synthetic fuels compatible with the range of petroleum fuels is:

Naptha: 20%–60%
Methanol: 10%–40%
Butanol: 20%–40%
Magnesium Laurel Salts: 0.0001–0.001 pound/gallon It will thus be seen that the applicant has provided a new and novel composition of matter of great utility as a synthetic fuel which may be used either alone or in mixture as an extender with a petroleum fuel. Since certain changes in the composition described above will occur to those skilled in the art without departure from the scope of the invention it is intended that all matter contained herein shall be interpreted as illustrative and not in a limiting sense.

Having described what is new and novel and desired to secure by Letters Patent what is claimed is:

1. A synthetic fuel comprising
20 to 40 percent by volume butanol,
10 to 40 percent by volume methanol,
20 to 60 percent by volume heavy hydrocarbon, and
0.0001 to 0.001 pound of a colloid stabilizer per gallon of the remaining constituents.

2. A synthetic fuel as recited in claim 1, wherein
said heavy hydrocarbon is selected from the group of heavy hydrocarbons consisting of
naptha,
coal oil, and
vegetable oil.

3. A synthetic fuel as recited in claim 1, wherein
said colloid stabilizer is magnesium laurel salts.

4. A synthetic fuel as recited in claim 1 comprising
20 percent by volume butanol,
40 percent by volume methanol,
40 percent by volume heavy hydrocarbon, and
0.001 pound of colloid stabilizer per gallon of the remaining constituents.

5. The method of preparing a synthetic fuel, said method comprising the steps
preparing a mixture of 20 to 40 percent by volume butanol, 10 to 40 percent by volume methanol, and 20 to 60 percent by volume heavy hydrocarbon;
adding to said mixture 0.0001 to 0.001 pound of a colloid stabilizer per gallon of said mixture;
heating said mixture to a temperature sufficient to vaporize said mixture;
condensing said vaporized mixture to a liquid state; and
collecting the condensed mixture.

6. The method as recited in claim 5, wherein
said heavy hydrocarbon is selected from the group of heavy hydrocarbons consisting of
naptha,
coal oil, and
vegetable oil.

7. The method as recited in claim 5, wherein
said colloid stabilizer is magnesium laurel salts.

8. The method as recited in claim 5 wherein
said temperature in 300 degrees Fahrenheit.

9. The method as recited in claim 5, wherein
said mixture is prepared in the proportion of 20 percent by volume butanol, 40 percent by volume methanol and 40 percent by volume heavy hydrocarbon to which is added 0.001 pound of said colloid stabilizer per gallon.

10. The method as recited in claim 9, wherein
said heavy hydrocarbon is naptha and said colloid stabilizer is magnesium laurel salts.

11. The method as recited in claim 9 further including the step of mixing said synthetic fuel with gasoline in a predetermined ratio.

12. The method as recited in claim 10 wherein
said ratio is 75 percent by volume gasoline and 25 percent by volume said synthetic fuel.

* * * * *

UNITED STATES PATENT OFFICE

CERTIFICATE OF CORRECTION

Patent No. 4,300,912 Dated November 17, 1981

Inventor(s) David J. Townsend

It is certified that error appears in the above-identified patent and that said Letters Patent are hereby corrected as shown below:

In the heading:

Line [75] should read:

David J. Townsend, Panama City, Florida

Line [73] should read:

Doxa International Fuels, Inc., Lansing, Illinois

The Attorney, Agent or Firm of record reading Gerald R. O'Brien, Jr. should read Robert F. Van Epps.

Signed and Sealed this

*Twenty-first* Day of *September 1982*

[SEAL]

*Attest:*

GERALD J. MOSSINGHOFF

*Attesting Officer*

*Commissioner of Patents and Trademarks*